US008294444B2

(12) United States Patent
Chen

(10) Patent No.: US 8,294,444 B2
(45) Date of Patent: Oct. 23, 2012

(54) POWER TRACKING DEVICE AND POWER TRACKING METHOD THEREOF

(75) Inventor: Mei-Hua Chen, Taipei (TW)

(73) Assignees: Mei-Hua Chen, Taipei (TW); Sinergy Power Solutions Inc., Taipei (TW); Sinergy Micro Devices Inc., Keelung (TW)

( * ) Notice: Subject to any disclaimer, the term of this patent is extended or adjusted under 35 U.S.C. 154(b) by 434 days.

(21) Appl. No.: 12/719,918

(22) Filed: Mar. 9, 2010

(65) Prior Publication Data

US 2011/0221418 A1 Sep. 15, 2011

(51) Int. Cl.
*G05F 1/00* (2006.01)

(52) U.S. Cl. ..... 323/282; 323/283; 323/285

(58) Field of Classification Search ..... 323/222, 323/271, 282, 283, 284, 285, 299
See application file for complete search history.

(56) References Cited

U.S. PATENT DOCUMENTS

| | | | | |
|---|---|---|---|---|
| 7,230,406 | B2 * | 6/2007 | Huang et al. | 323/222 |
| 2006/0043943 | A1 * | 3/2006 | Huang et al. | 323/222 |
| 2007/0176581 | A1 * | 8/2007 | Chen et al. | 323/272 |
| 2009/0201003 | A1 * | 8/2009 | Kobori et al. | 323/284 |

* cited by examiner

*Primary Examiner* — Nguyen Tran
(74) *Attorney, Agent, or Firm* — Thomas|Kayden

(57) ABSTRACT

A power tracking device for a power generation apparatus is provided. A multiplier generates a power level signal according to a current signal and a voltage signal both sensed from the output of the power generation apparatus. A sample-and-hold circuit samples the power level signal according to a sampling clock and generates a current level signal, a peak level signal, and a threshold level signal according to an update signal. A compare circuit compares the current, peak and threshold level signals to generate the update signal and a change signal. A converter performs pulse width modulation (PWM) to generate a PWM signal according to a control signal corresponding to the change signal and converts the output of the power generation apparatus to a load according to the PWM signal.

17 Claims, 9 Drawing Sheets

POWER TRACKING DEVICE AND POWER TRACKING METHOD THEREOF

BACKGROUND OF THE INVENTION

1. Field of the Invention

The invention relates to a power tracking device, and more particularly to a power tracking device for identifying a maximum power point of a power generation apparatus.

2. Description of the Related Art

Power generation apparatuses, such as photovoltaic power generators, wind power generators, and heat power generators etc., are widely used in various systems. Conversion efficiency of a power generation apparatus is dependant on the conditions of both the load and energy source of the power generation apparatus. The energy source of a power generation apparatus may not be stable (e.g. wind power or solar power levels may vary) and a load of a power generation apparatus may also vary. Thus, dynamic control techniques are applied to power generation apparatuses to obtain maximum conversion efficiency of the power generation apparatuses.

FIG. 1 shows a diagram illustrating a relationship between voltage and current of an output power of a power generation apparatus. In FIG. 1, curve S1 represents the current/voltage curve of the output power at lower temperature, curve S2 represents the current/voltage curve of the output power at middle temperature, and curve S3 represents the current/voltage curve of the output power at higher temperature. As shown by the curves S1, S2 or S3, when the value of the current of the output power is maximized, the voltage level of the output power tends is minimized, and vice versa. Furthermore, curve S4 represents the output power according to the voltage at lower temperature, curve S5 represents the output power according to the voltage at middle temperature, and curve S6 represents the output power according to the voltage at higher temperature. Thus, the maximum power points of the curves S4, S5 and S6 are different. Namely, different conditions will affect the maximum power point for the power generation apparatus, such as variations in wind force, light density, temperature, load, and so on. In order to obtain the maximum conversion efficiency for a power generation apparatus, a tracking technique is required to track the power level of the power generation apparatus, to identify the maximum power point and transfer the maximum output power from the power generation apparatus to the load.

Typically, a maximum power point for a power generation apparatus may be identified by measuring and comparing the voltage and the current from the power generation apparatus. However, there are many possible voltage/current points which may be detected, as shown in the curves of FIG. 1. Thus, identifying a maximum power point by the measuring and comparing of voltage/current technique is complex and inefficient.

Furthermore, an analog to digital converter (ADC) is used to sample the voltage and the current from a power generation apparatus and/or from a load and then process the sampled voltage and the sampled current digitally. Next, a digital to analog converter (DAC) is used to convert the computed digital signals to analog signals, so as to output the analog signal to a pulse width modulation (PWM) device for power control. While digital processes may be flexible when implementing maximum power point tracking, however, tracking efficiency thereof is limited by the resolution and conversion speed of the ADC and the DAC used, as well as computing power. Meanwhile, if a high resolution, high conversion speed or high computing power ADC and DAC is used, required area increases along with costs.

Therefore, a power tracking device for a power generation apparatus is desired, which simply, quickly, flexibly, and inexpensively identifies a maximum power point of a power generation apparatus.

BRIEF SUMMARY OF THE INVENTION

A Power tracking device and power tracking method therefore for a power generation apparatus are provided. An exemplary embodiment of a power tracking device for a power generation apparatus comprises a multiplier, a sample-and-hold circuit, a compare circuit and a converter. The multiplier generates a power level signal according to a current signal and a voltage signal both sensed from an output signal of the power generation apparatus. The sample-and-hold circuit samples the power level signal according to a sampling clock and generates a current level signal indicating a current level of the sampled power level signal, a peak level signal indicating a peak level of a sampled power level signal that was previously sampled, and a threshold level signal indicating a threshold level of the sampled power level signal according to an update signal. The compare circuit compares the current, peak and threshold level signals to generate the update signal and a change signal according to the sampling clock. The converter performs pulse width modulation (PWM) to generate a PWM signal according to a control signal corresponding to the change signal and converts the output from the power generation apparatus to a load according to the PWM signal, wherein the duty cycle of the PWM signal is controlled by the control signal.

Furthermore, an exemplary embodiment of a power tracking method for a power generation apparatus is provided. A power level signal is obtained according to a current signal and a voltage signal both sensed from the output of the power generation apparatus. The power level signal is sampled to generate a current level signal indicating a current level of the sampled power level signal, a peak level signal indicating a peak level of a sampled power level signal that was previously sampled, and a threshold level signal indicating a threshold level of the sampled power level signal according to an update signal. The current, peak and threshold level signals are compared to generate the update signal and a change signal according to the sampling clock. The output signal of the power generation apparatus is converted, to generate a power signal, to a load according to a control signal corresponding to the change signal.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
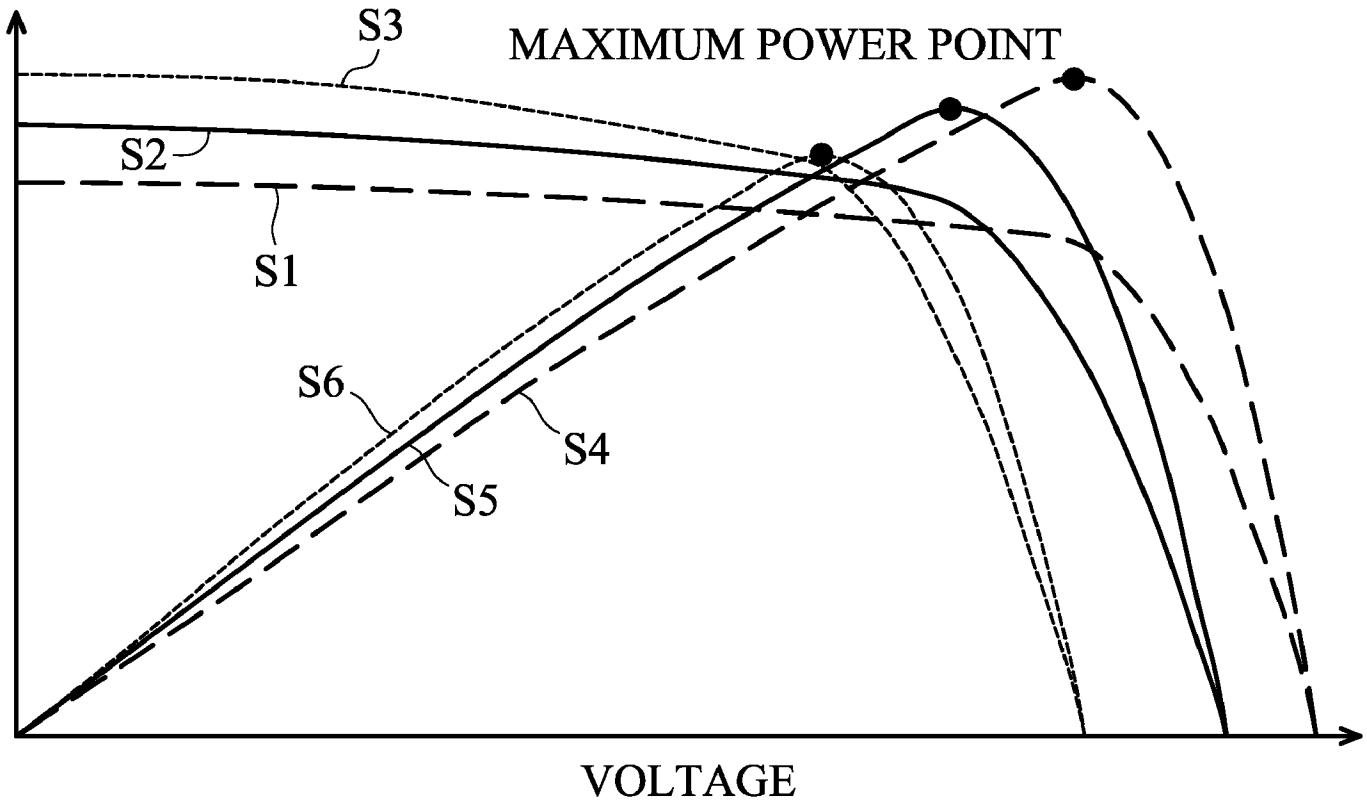
FIG. 1 ( PRIOR ART )
FIG. 1 shows a diagram illustrating a relationship between voltage and current of an output power of a power generation apparatus.
Figure 2:
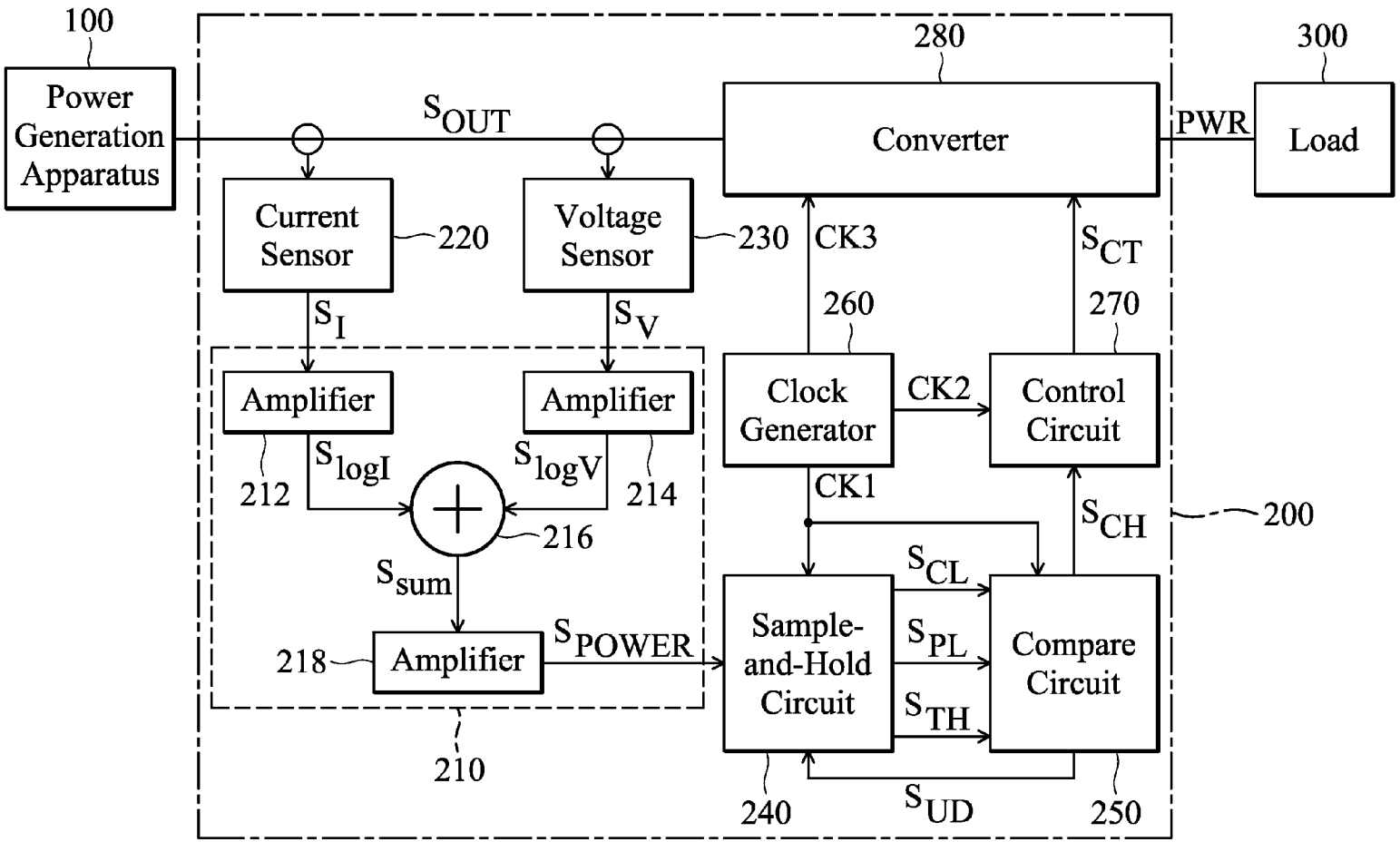
FIG. 2 shows a power tracking device for a power generation apparatus according to an embodiment of the invention.

FIG. 2 shows a power tracking device 200 for a power generation apparatus 100 according to an embodiment of the invention. The power tracking device 200 comprises a multiplier 210, a current sensor 220, a voltage sensor 230, a sample-and-hold circuit 240, a compare circuit 250, a clock generator 260, a control circuit 270 and a converter 280. The current sensor 220 and the voltage sensor 230 are coupled between the power generation apparatus 100 and the multiplier 210. The current sensor 220 and the voltage sensor 230 sense an output $S_{OUT}$ from the power generation apparatus 100 to generate a current signal $S_I$ and a voltage signal $S_V$, and transmit them to the multiplier 210, respectively. The multiplier 210 generates a power level signal $S_{POWER}$ indicating a power level of the output $S_{OUT}$ of the power generation apparatus 100 according to the current signal $S_I$ and the voltage signal $S_V$. The sample-and-hold circuit 240 samples the power level signal $S_{POWER}$ according to a sampling clock CK1 from the clock generator 260 and generates a current level signal $S_{CL}$, a peak level signal $S_{PL}$ and a threshold level signal $S_{TH}$, and transmits them to the compare circuit 250 according to an update signal $S_{UD}$ provided by the compare circuit 250, wherein the current level signal $S_{CL}$ represents a current level of the sampled power level signal $S_{POWER}$, the peak level signal $S_{PL}$ represents a peak level of the sampled power level signal $S_{POWER}$ that has appeared before, and the threshold level signal $S_{TH}$ represents a threshold level of the sampled power level signal $S_{POWER}$. The compare circuit 250 compares the current level signal $S_{CL}$, the peak level signal $S_{PL}$ and the threshold level signal $S_{TH}$ to generate the update signal $S_{UD}$, and transmit it to the sample-and-hold circuit 240 and generate a change signal $S_{CH}$, and transmit it to the control circuit 270. The clock generator 260 generates the sampling clock CK1, and transmits it to the sample-and-hold circuit 240, generates the compare circuit 250 and a level change clock CK2, and transmits them to the control circuit 270, and generates a saw-tooth signal CK3, and transmits it to the converter 280, wherein the clock generator 260 transmits the saw-tooth signal CK3 to the converter 280 for performing pulse width modulation (PWM) to generate a PWM signal $S_{PWM}$. The control circuit 270 generates a control signal $S_{CT}$, and transmits it to the converter 280 according to the level change clock CK2 and the change signal $S_{CH}$, so as to control the duty cycle of the PWM signal $S_{PWM}$. The converter 280 generates a power signal PWR, and transmits it to a load 300 according to the PWM signal $S_{PWM}$. In an embodiment, the converter 280 is a DC/DC converter or a DC/AC converter.

Figure 3:
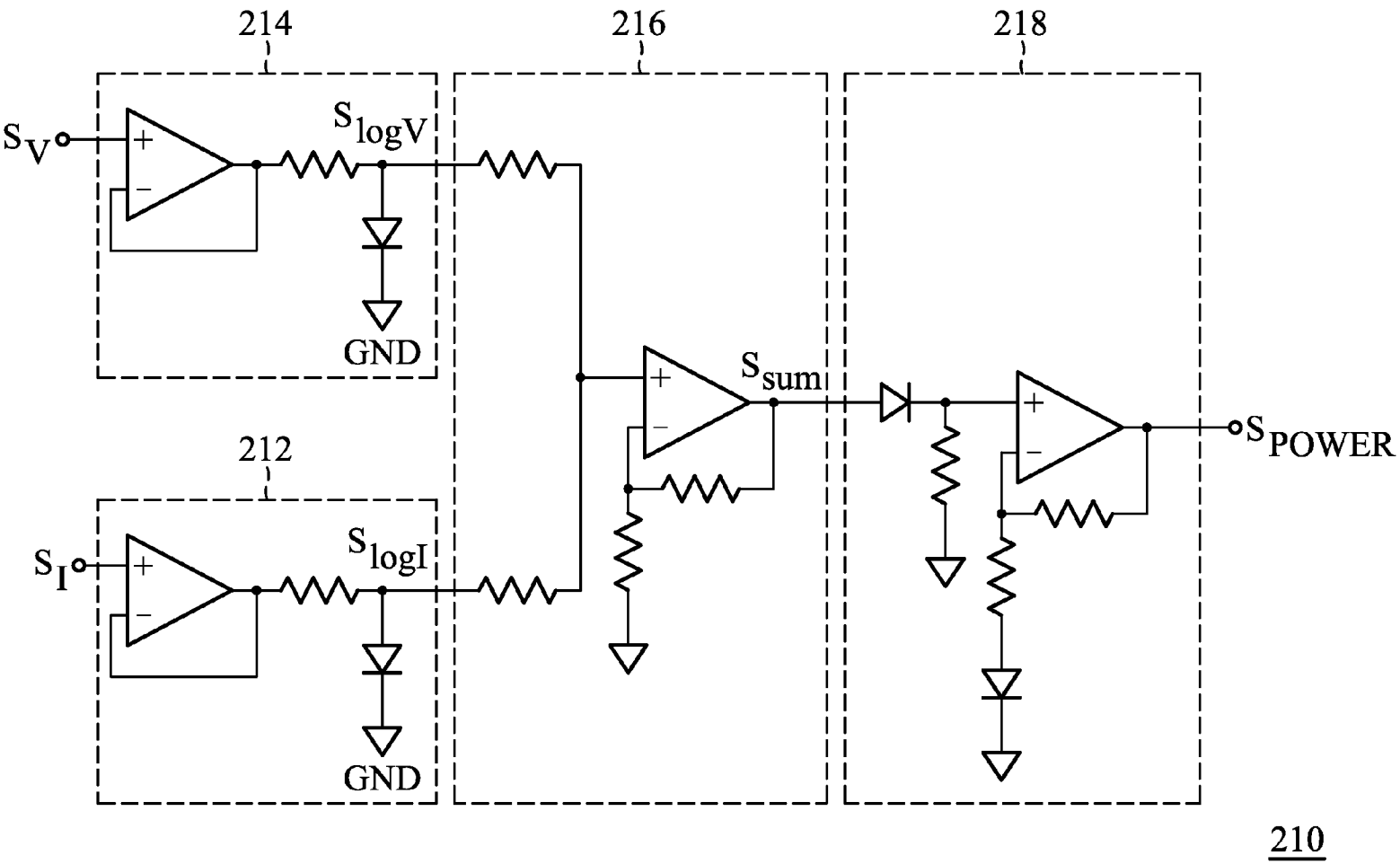
FIG. 3 shows an exemplary schematic illustrating the multiplier of FIG. 2 according to an embodiment of the invention.

In FIG. 2, the multiplier 210 comprises two logarithm (log) amplifiers 212 and 214, an adder 216 and an exponential amplifier 218. Referring to FIG. 3, FIG. 3 shows an exemplary schematic illustrating the multiplier 210 according to an embodiment of the invention. As shown in FIG. 2 and FIG. 3, the logarithm amplifier 212 is coupled between the current sensor 220 and the adder 216, and the logarithm amplifier 214 is coupled between the voltage sensor 230 and the adder 216. The logarithm amplifier 212 converts the current signal $S_I$ from a linear to logarithmic format to generate a logarithmic signal $S_{logI}$, and the logarithm amplifier 214 converts the voltage signal $S_V$ from a linear to logarithmic format to generate a logarithmic signal $S_{logV}$. Next, the adder 216 sums up the logarithmic signals $S_{logI}$ and $S_{logV}$ to generate a summation signal $S_{sum}$. The exponential amplifier 218 is coupled between the adder 216 and the sample-and-hold circuit 240, and is used to convert the summation signal $S_{sum}$ from a logarithmic to linear format to generate the power level signal $S_{POWER}$.

Figure 4:
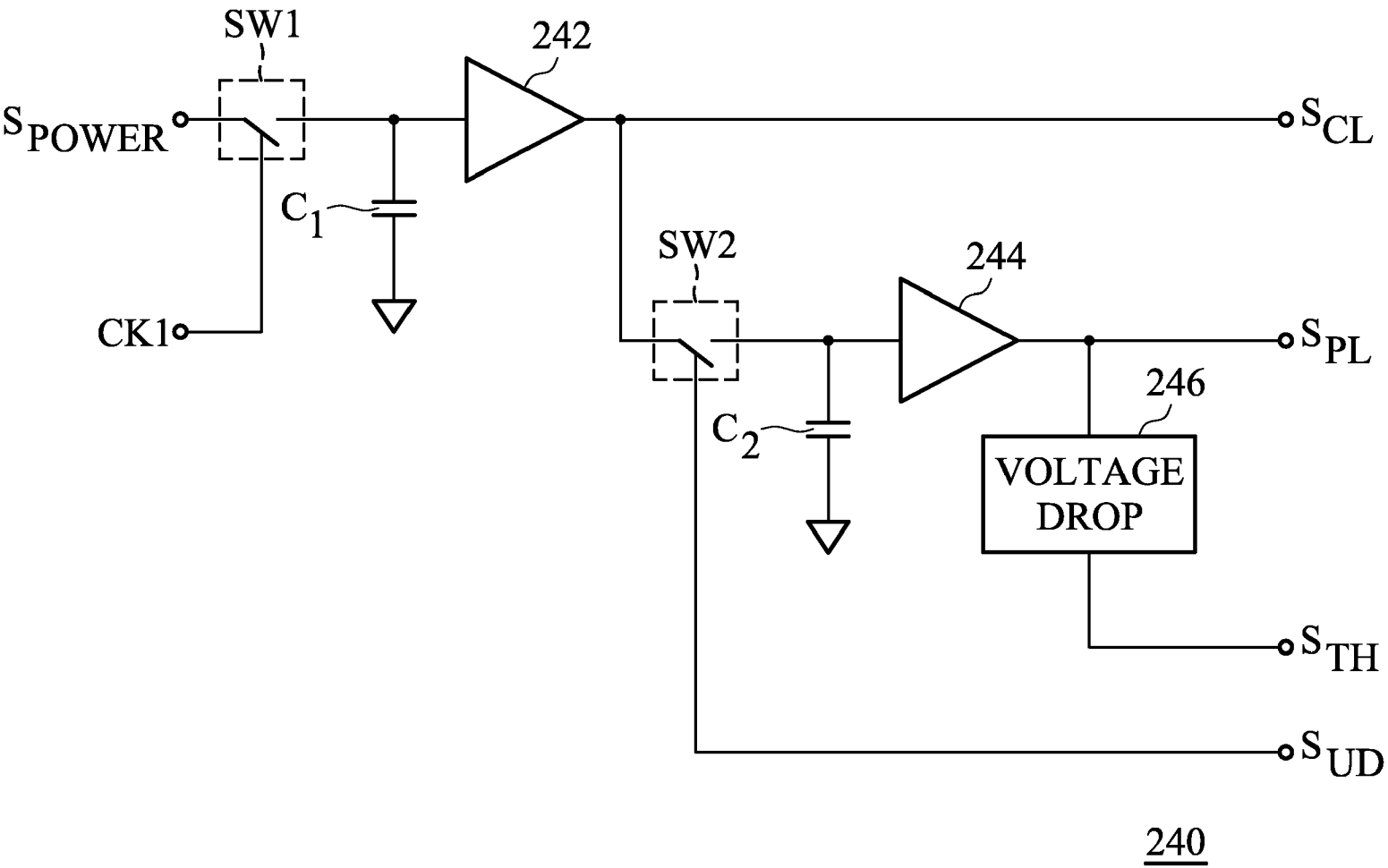
FIG. 4 shows an exemplary schematic illustrating the sample-and-hold circuit of FIG. 2 according to an embodiment of the invention.

FIG. 4 shows an exemplary schematic illustrating the sample-and-hold circuit 240 according to an embodiment of the invention. The sample-and-hold circuit 240 comprises two switches SW1 and SW2, two capacitors $C_1$ and $C_2$, two amplifiers 242 and 244 and a voltage drop unit 246. The switch SW1 is controlled by the sampling clock CK1. The capacitor $C_1$ is charged by the power level signal $S_{POWER}$ when the switch SW1 is turned on. Thus, the power level signal $S_{POWER}$ is sampled. Next, the amplifier 242 generates the current level signal $S_{CL}$ according to the voltage of the capacitor $C_1$ which is the sampled power level signal $S_{POWER}$. The switch SW2 is controlled by the update signal $S_{UD}$. The capacitor $C_2$ is charged by the current level signal $S_{CL}$ when the switch SW2 is turned on. Next, the amplifier 244 generates the peak level signal $S_{PL}$ according to the voltage of the capacitor $C_2$ which is a peak level of a previously sampled power level signal $S_{POWER}$. Next, the voltage drop unit 246 generates the threshold level signal $S_{TH}$ according to the peak level signal $S_{PL}$ and a drop voltage $\Delta V$, wherein the drop voltage $\Delta V$ may be determined according to requirements.

Figure 5:
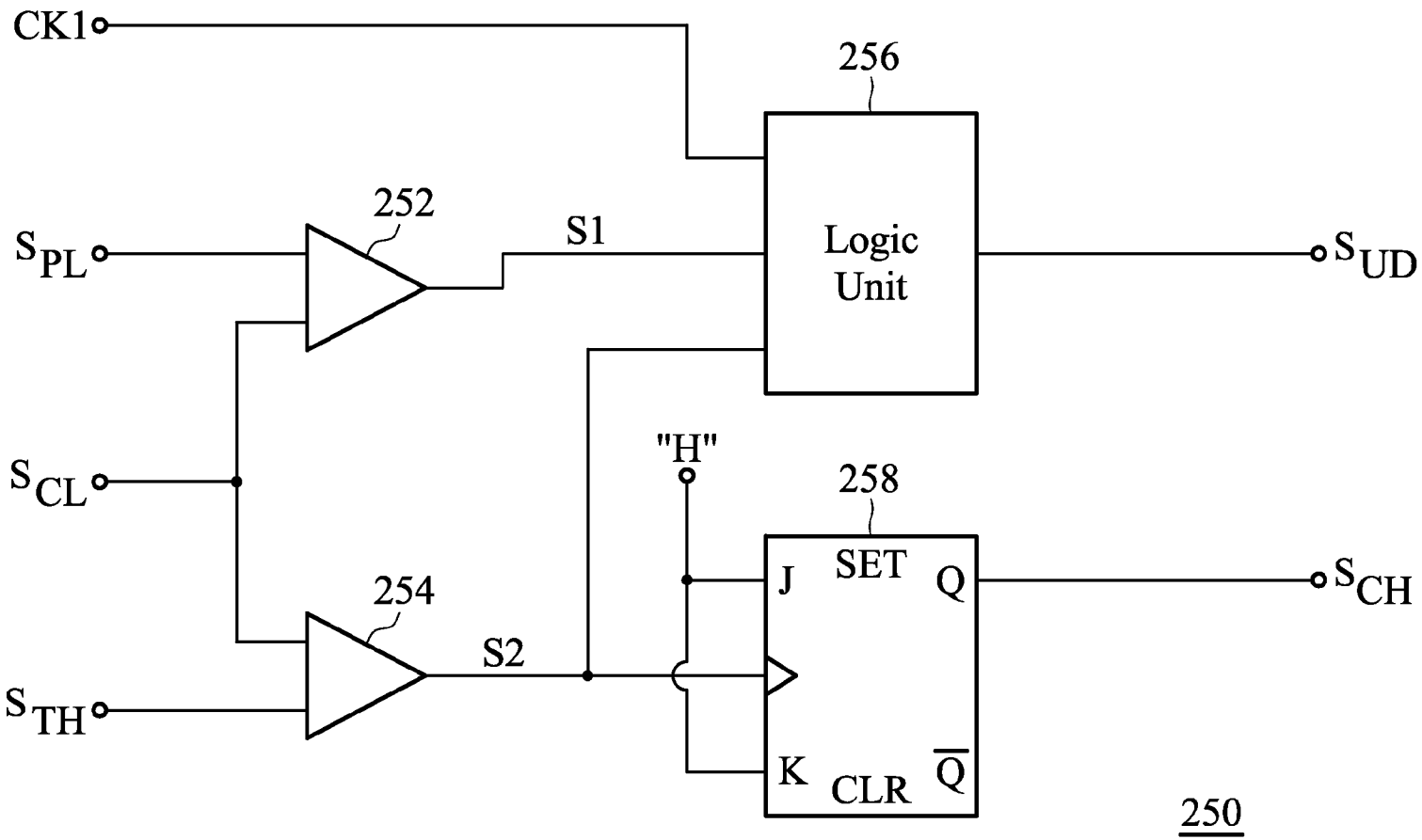
FIG. 5 shows an exemplary schematic illustrating the compare circuit of FIG. 2 according to an embodiment of the invention.
Figure 6:
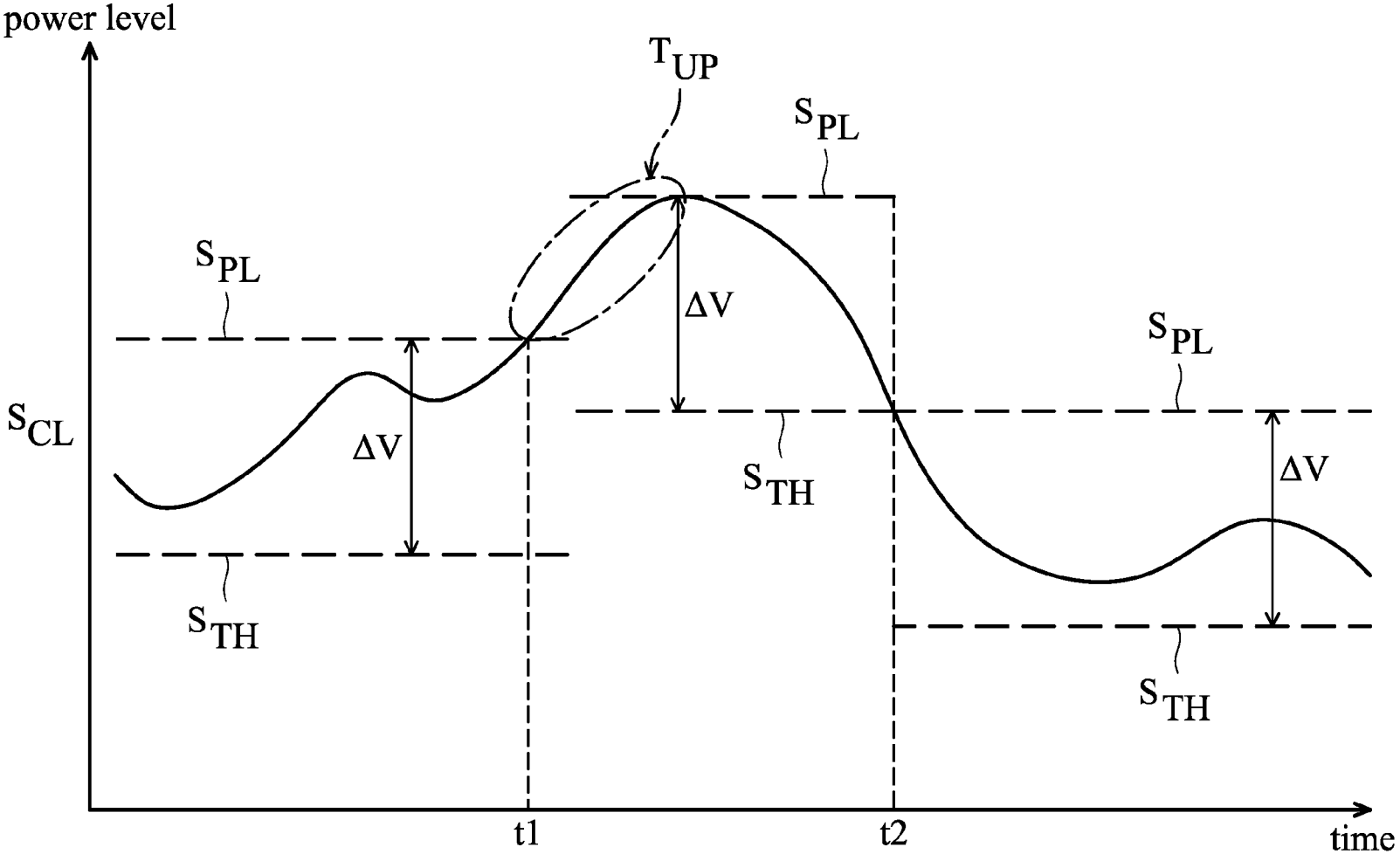
FIG. 6 shows a diagram illustrating a variation relationship between the current level signal $S_{CL}$, the peak level signal $S_{PL}$ and the threshold level signal $S_{TH}$ of FIG. 5.

FIG. 5 shows an exemplary schematic illustrating the compare circuit 250 according to an embodiment of the invention. The compare circuit 250 comprises two comparators 252 and 254, a logic unit 256 and a flip-flop register 258. The comparator 252 compares the peak level signal $S_{PL}$ with the current level signal $S_{CL}$ to generate a signal S1. The comparator 254 compares the current level signal $S_{CL}$ with the threshold level signal $S_{TH}$ to generate a signal S2. The logic unit 256 generates the update signal $S_{UD}$ according to the sampling clock CK1 and the signals S1 and S2. The flip-flop register 258 generates the change signal $S_{CH}$ according to the signal S2. In an embodiment, the flip-flop register 258 may be a J-K type flip-flop register or a T type flip-flop register. FIG. 6 shows a diagram illustrating a variation relationship between the current level signal $S_{CL}$, the peak level signal $S_{PL}$ and the threshold level signal $S_{TH}$ of FIG. 5. First, the peak level signal $S_{PL}$ and the threshold level signal $S_{TH}$ form a dynamic hysteresis window, wherein the range of the hysteresis window is determined according to the drop voltage $\Delta V$ of the voltage drop unit 246 in FIG. 4. Referring to FIG. 5 and FIG. 6 together, at time point t1, the comparator 252 generates the signal S1 to indicate that the current level signal $S_{CL}$ is larger than the peak level signal $S_{PL}$. Thus, the logic unit 256 transmits the update signal $S_{UD}$ to the sample-and-hold circuit 240, so as to update the peak level signal $S_{PL}$ and the threshold level signal $S_{TH}$. During an update period $T_{UP}$, the peak level signal $S_{PL}$ and the threshold level signal $S_{TH}$ are constantly updated. Next, at time point t2, the comparator 254 generates the signal S2 to indicate that the current level signal $S_{CL}$ is smaller than the threshold level signal $S_{TH}$. Thus, the logic unit 256 transmits the update signal $S_{UD}$ to the sample-and-hold circuit 240 and then the sample-and-hold circuit 240 replaces the peak level signal $S_{PL}$ with the current level signal $S_{CL}$ and obtains a new threshold level signal $S_{TH}$ according to the replaced peak level signal $S_{PL}$ and the drop voltage ΔV. Simultaneously, the flip-flop register 258 changes a polarity of the change signal $S_{CH}$. In the embodiment, the flip-flop register 258 may maintain the polarity of the change signal $S_{CH}$ when the current level signal $S_{CL}$ is within the hysteresis window, i.e. the current level signal $S_{CL}$ is larger than the threshold level signal $S_{TH}$ and smaller than the peak level signal $S_{PL}$.

Figure 7:
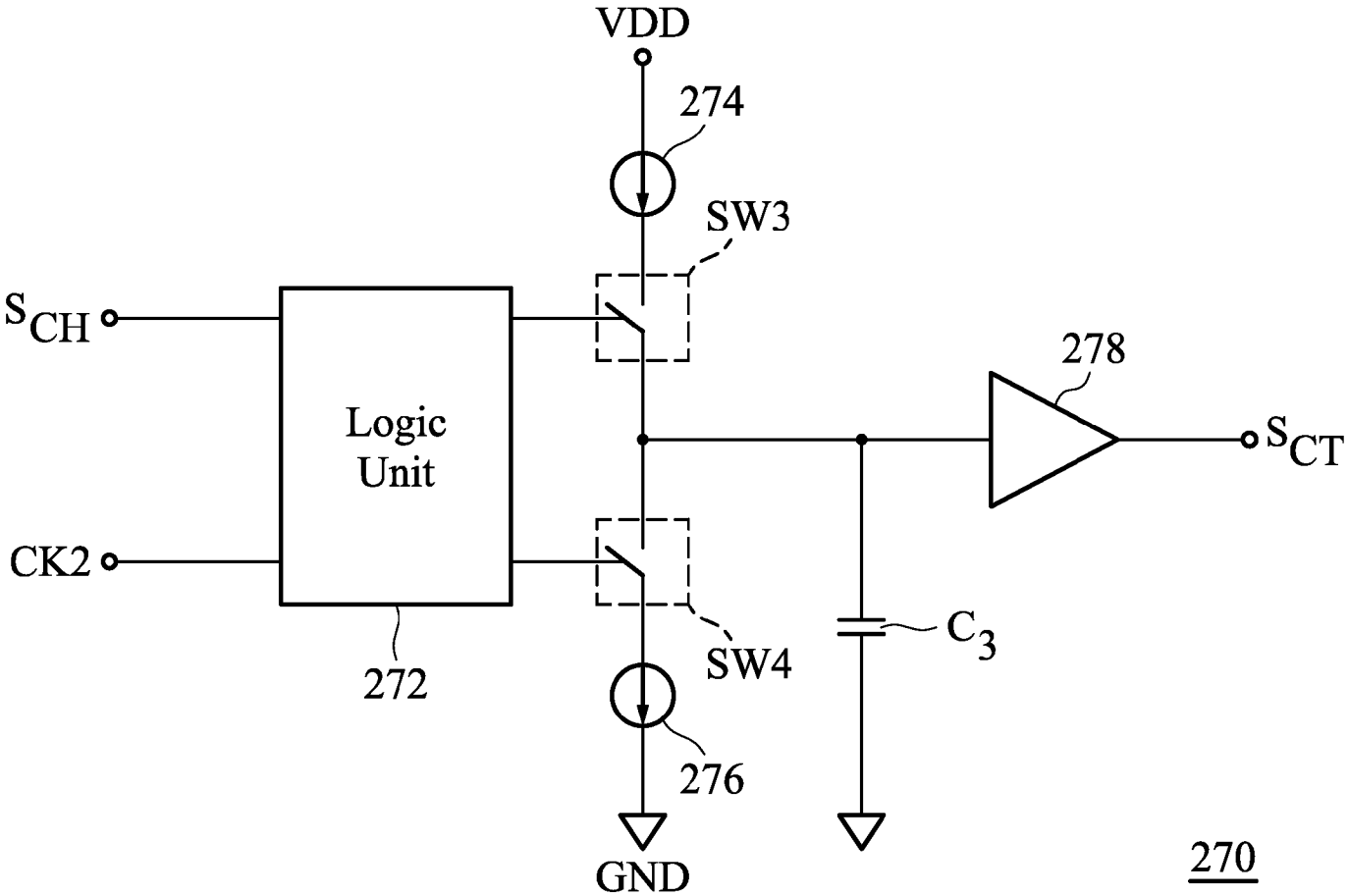
FIG. 7 shows an exemplary schematic illustrating the control circuit according to an embodiment of the invention.

FIG. 7 shows an exemplary schematic illustrating the control circuit 270 according to an embodiment of the invention. The control circuit 270 comprises a logic unit 272, two current sources 274 and 276, an amplifier 278, two switches SW3 and SW4 and a capacitor $C_3$. The current source 274 is coupled to a power supply voltage VDD. The switch SW3 is coupled between the current source 274 and the switch SW4. The current source 276 is coupled between the switch SW4 and a ground GND. The logic unit 272 controls the switch SW3 so that it is turned on according to the change signal $S_{CH}$ and the level change clock CK2, so as to charge the capacitor $C_3$ through the current source 274. In addition, the logic unit 272 controls the switch SW4 so that it is turned on according to the change signal $S_{CH}$ and the level change clock CK2, so as to discharge the capacitor $C_3$ through the current source 276. Thus, the amplifier 278 generates the control signal $S_{CT}$ according to a voltage of the capacitor $C_3$.

Figure 8:
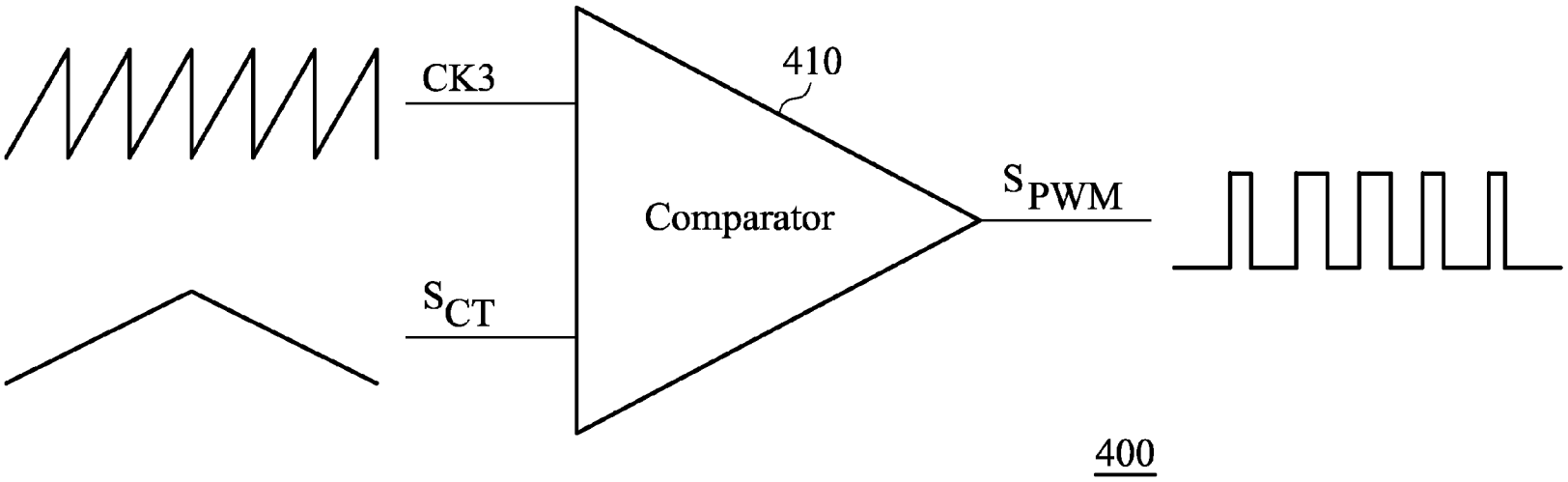
FIG. 8 shows an exemplary schematic illustrating a PWM circuit of the converter of FIG. 2 according to an embodiment of the invention.

FIG. 8 shows an exemplary schematic illustrating a PWM circuit 400 of the converter 280 according to an embodiment of the invention. The PWM circuit 400 comprises a comparator 410 which is used to perform PWM to generate the PWM signal $S_{PWM}$. The comparator 410 compares the saw-tooth signal CK3 from the clock generator 260 of FIG. 2 with the control signal $S_{CT}$ to generate the PWM signal $S_{PWM}$, wherein the duty cycle of the PWM signal $S_{PWM}$ is controlled according to the control signal $S_{CT}$. The switching points of the control signal $S_{CT}$ occur at the time points that the current level signal $S_{CL}$ is smaller than the threshold level signal $S_{TH}$, as shown in time point t2 in FIG. 6. In other words, the control signal $S_{CT}$ is reversed when the polarity of the change signal $S_{CH}$ changes.

Figure 9:
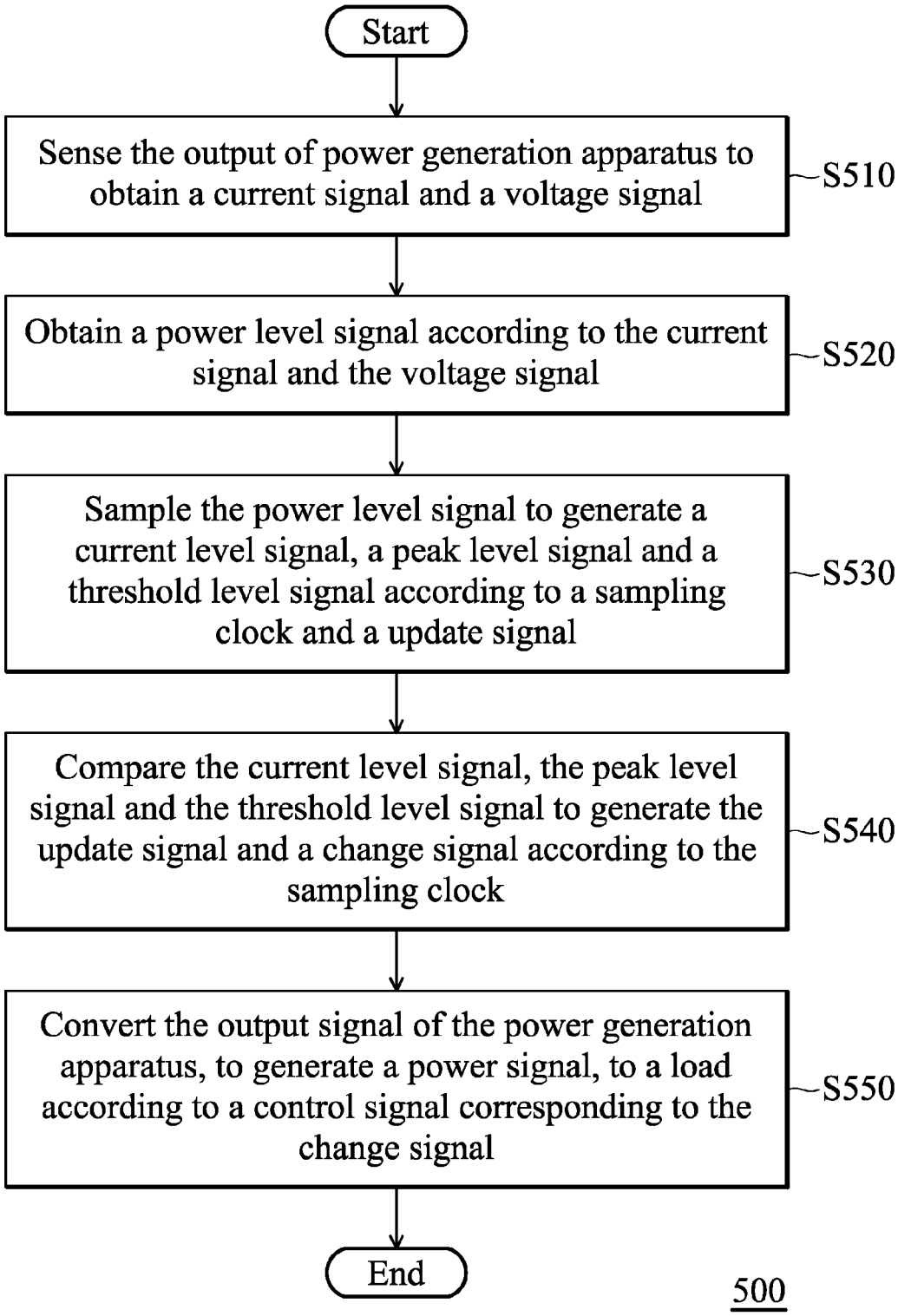
FIG. 9 shows a power tracking method for a power generation apparatus according to an embodiment of the invention.

FIG. 9 shows a power tracking method 500 for a power generation apparatus according to an embodiment of the invention. First, in step S510, an output of the power generation apparatus is sensed to obtain a current signal (e.g. $S_I$ of FIG. 2) and a voltage signal (e.g. $S_V$ of FIG. 2). Next, in step S520, a power level signal (e.g. $S_{POWER}$ of FIG. 2) is obtained according to the current signal and the voltage signal by converting the current signal and the voltage signal from a linear to logarithmic format to generate two logarithmic signals, summing up the two logarithmic signals and converting the summed signal from a logarithmic to linear format. Next, in step S530, the power level signal is sampled to generate a current level signal (e.g. $S_{CL}$ of FIG. 2) indicating a power level of the current sampled power level signal, a peak level signal (e.g. $S_{PL}$ of FIG. 2) indicating a peak power level of a previously sampled power level signal, and a threshold level signal (e.g. $S_{TH}$ of FIG. 2) indicating a threshold level of the sampled power level signal according to a sampling clock (e.g. CK1 of FIG. 2) and an update signal (e.g. $S_{UD}$ of FIG. 2). Next, in step S540, the current level signal, the peak level signal and the threshold level signal are compared to generate the update signal and a change signal (e.g. $S_{CH}$ of FIG. 2) according to the sampling clock. Next, in step S550, the output of the power generation apparatus is converted to a load according to a control signal corresponding to the change signal, so as to identify the maximum power point for the power generation apparatus.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A power tracking device for a power generation apparatus, comprising:

a multiplier, generating a power level signal according to a current signal and a voltage signal both sensed from an output signal of the power generation apparatus;

a sample-and-hold circuit, sampling the power level signal according to a sampling clock and generating a current level signal indicating a current level of the sampled power level signal, a peak level signal indicating a peak level of a sampled power level signal that was previously sampled and a threshold level signal indicating a threshold level of the sampled power level signal according to an update signal;

a compare circuit, comparing the current, peak and threshold level signals to generate the update signal and a change signal according to the sampling clock; and a control circuit coupled to the compare circuit, generating a control signal according to the change signal and a level change clock.

2. The power tracking device as claimed in claim 1, further comprising:

a clock generator, generating the sampling clock and the level change clock; and a converter, performing pulse width modulation (PWM) to generate a PWM signal according to the control signal corresponding to the change signal and converting the output signal of the power generation apparatus, to generate a power signal, to a load according to the PWM signal, wherein the duty cycle of the PWM signal is controlled by the control signal.

3. The power tracking device as claimed in claim 2, wherein the converter is a DC/DC converter or a DC/AC converter.

4. The power tracking device as claimed in claim 1, further comprising:

a current sensor coupled between the power generation apparatus and the multiplier, sensing the output signal of the power generation apparatus to generate the current signal; and a voltage sensor coupled between the power generation apparatus and the multiplier, sensing the output signal of the power generation apparatus to generate the voltage signal.

5. The power tracking device as claimed in claim 4, wherein the multiplier comprises:

a first logarithm amplifier coupled to the current sensor, converting the current signal from a linear to logarithmic format to generate a first logarithmic signal;

a second logarithm amplifier coupled to the voltage sensor, converting the voltage signal from a linear to logarithmic format to generate a second logarithmic signal;

an adder, summing up the first and second logarithmic signals to generate a summation signal; and an exponential amplifier, converting the summation signal from a logarithmic to linear format to generate the power level signal.

6. The power tracking device as claimed in claim 1, wherein the compare circuit generates the update signal and transmits it to the sample-and-hold circuit according to the sampling clock when the current level signal is larger than the peak level signal, and the sample-and-hold circuit updates the peak level signal and the threshold level signal according to the update signal.

7. The power tracking device as claimed in claim 1, wherein the compare circuit generates the update signal and transmits it to the sample-and-hold circuit according to the sampling clock and changes a polarity of the change signal when the current level signal is smaller than the threshold level signal, and the sample-and-hold circuit replaces the peak level signal with the current level signal according to the update signal.

8. The power tracking device as claimed in claim 7, wherein the compare circuit holds the polarity of the change signal when the current level signal is larger than the threshold level signal and smaller than the peak level signal.

9. A power tracking method for a power generation apparatus, comprising:

obtaining a power level signal according to a current signal and a voltage signal both sensed from the output of the power generation apparatus;

sampling the power level signal according to a sampling clock and generating a current level signal indicating a current level of the sampled power level signal, a peak level signal indicating a peak level of a sampled power level signal that was previously sampled and a threshold level signal indicating a threshold level of the sampled power level signal according to an update signal;

comparing the current, peak and threshold level signals to generate the update signal and a change signal according to the sampling clock; and converting the output of the power generation apparatus, to a load according to a control signal corresponding to the change signal.

10. The power tracking method as claimed in claim 9, further comprising:

obtaining the sampling clock and a level change clock; and obtaining the control signal according to the change signal and the level change clock.

11. The power tracking method as claimed in claim 9, further comprising:

sensing the output of the power generation apparatus to generate the current signal; and sensing the output of the power generation apparatus to generate the voltage signal.

12. The power tracking method as claimed in claim 9, wherein the step of obtaining the power level signal further comprises:

converting the current signal from a linear to logarithmic format to generate a first logarithmic signal;

converting the voltage signal from a linear to logarithmic format to generate a second logarithmic signal;

summing up the first and second logarithmic signals to generate a summation signal; and converting the summation signal from a logarithmic to linear format to generate the power level signal.

13. The power tracking method as claimed in claim 9, wherein the step of comparing the current, peak and threshold level signals further comprises:

obtaining the update signal when the current level signal is larger than the peak level signal, so as to update the peak level signal and the threshold level signal.

14. The power tracking method as claimed in claim 9, wherein the step of comparing the current, peak and threshold level signals further comprises:

obtaining the update signal and changing a polarity of the change signal when the current level signal is smaller than the threshold level signal, so as to replace the peak level signal with the current level signal.

15. The power tracking method as claimed in claim 14, wherein the step of comparing the current, peak and threshold level signals further comprises:

maintaining the polarity of the change signal when the current level signal is larger than the threshold level signal and smaller than the peak level signal.

16. The power tracking method as claimed in claim 14, further comprising:

reversing the control signal when the polarity of the change signal changes.

17. The power tracking method as claimed in claim 9, wherein the step of converting the output signal of the power generation apparatus further comprises:

performing pulse width modulation to generate a PWM signal, wherein the duty cycle of the PWM signal is controlled by the control signal; and converting the output of the power generation apparatus to the load according to the PWM signal.

* * * * *